US007939464B2

(12) United States Patent
Utagawa et al.

(10) Patent No.: US 7,939,464 B2
(45) Date of Patent: May 10, 2011

(54) STRUCTURE WITH A BUILT-IN RECORDING MEDIUM, A LAMINATE COMPRISING THE STRUCTURE AND METHOD FOR RECORDING IN NON-CONTACT MANNER USING THE STRUCTURE AND THE LAMINATE

(75) Inventors: Tetsuyuki Utagawa, Kawaguchi (JP); Takeshi Segawa, Saitama (JP); Takehiko Nishikawa, Saitama (JP); Chisato Iino, Koshigaya (JP)

(73) Assignee: Lintec Corporation, Tokyo (JP)

( * ) Notice: Subject to any disclaimer, the term of this patent is extended or adjusted under 35 U.S.C. 154(b) by 862 days.

(21) Appl. No.: 11/978,515

(22) Filed: Oct. 29, 2007

(65) Prior Publication Data

US 2008/0119359 A1 May 22, 2008

(30) Foreign Application Priority Data

Nov. 16, 2006 (JP) ..... 2006-310112

(51) Int. Cl.
*B41M 5/30* (2006.01)

(52) U.S. Cl. ..... 503/201; 503/200

(58) Field of Classification Search ..... None
See application file for complete search history.

(56) References Cited

U.S. PATENT DOCUMENTS

| | | | |
|---|---|---|---|
| 5,274,460 | A | 12/1993 | Yamada et al. |
| 6,956,010 | B2 | 10/2005 | Tsukida et al. |
| 7,018,952 | B2 | 3/2006 | Tsukida et al. |
| 7,338,919 | B2 | 3/2008 | Kawahara et al. |
| 2005/0130840 | A1 | 6/2005 | Tatewaki et al. |
| 2005/0170960 | A1 | 8/2005 | Tsukida et al. |
| 2007/0063058 | A1 | 3/2007 | Iwakata et al. |

FOREIGN PATENT DOCUMENTS

| | | | |
|---|---|---|---|
| EP | 1 502 763 | A1 | 2/2005 |
| EP | 1 571 005 | A1 | 9/2005 |
| EP | 1 304 674 | A1 | 12/2005 |
| EP | 1 767 377 | A1 | 3/2007 |
| JP | 2741435 | B2 | 1/1998 |
| JP | 2003-118238 | A | 4/2003 |
| JP | 2004-265249 | A | 9/2004 |
| JP | 2006-231647 | A | 9/2006 |
| SG | 131 041 | A1 | 4/2007 |

OTHER PUBLICATIONS

U.S. Appl. No. 11/977,544, filed Oct. 29, 2007, Comfirmation No. 2584.
Singapore Office Action, Invitation to Respond to Written Opinion, Aug. 11, 2008.
Australian Patent Office Written Opinion, Jul. 7, 2008.
Australian Patent Office Search Report, Jul. 7, 2008.

*Primary Examiner* — Bruce H Hess
(74) *Attorney, Agent, or Firm* — Holtz, Holtz, Goodman & Chick PC

(57) ABSTRACT

A structure formed of a resin material with a built-in recording medium comprising at least a means for rewriting visible information with a laser light in a non-contact manner; a laminate comprising the structure and a method for recording in the non-contact manner using the structure or the laminate are disclosed. The recording and erasing of information in the recording medium can be conducted by irradiation with a laser light from outside. The laser light transmittance in a used wave length range and the visible light transmittance through a portion of the structure from a surface on which the laser light is irradiated to the recording medium are in a specified range. Surface destruction of the recording medium due to laser light on rewriting visible information, decrease in durability during cleaning, damages on the recording medium during transportation and deterioration in the color developing property due to light can be overcome.

12 Claims, 2 Drawing Sheets

STRUCTURE WITH A BUILT-IN RECORDING MEDIUM, A LAMINATE COMPRISING THE STRUCTURE AND METHOD FOR RECORDING IN NON-CONTACT MANNER USING THE STRUCTURE AND THE LAMINATE

TECHNICAL FIELD

The present invention relates to a structure with a built-in recording medium, a laminate comprising the structure and a method for recording in the non-contact manner using the structure and the laminate comprising the structure. More particularly, the present invention relates to a structure formed of a resin material holding at the inside thereof a recording medium comprising at least a means for rewriting visible information with laser light in the non-contact manner and a laminate comprising the structure, which provide improvement in durability of the recording medium under repeated irradiation with laser light, prevention of attachment of dirt to the surface of the recording medium and protection from external impact, and to a method for recording visible information or both of visible information and invisible information using the structure or the laminate comprising the structure in the non-contact manner.

BACKGROUND ART

As the label for control of articles such as labels attached to plastic containers used for transporting foods (good-delivery boxes), labels used for control of electronic parts and labels attached to cardboard boxes for control of distribution of articles, currently, labels having a heat-sensitive recording material (direct thermal papers and the like) as the surface stock are mainly used.

In the heat sensitive recording material, a heat sensitive recording layer containing an electron-donating and, in general, colorless or lightly colored dye precursor and an electron-accepting color developing agent as the main components is formed on a support. By heating the heat sensitive recording material by a heated head or a heated pen, the dye precursor and the color developing agent react instantaneously with each other, and a recording image can be obtained. Once the image is formed, it is impossible that the image in the heat sensitive recording material described above is erased to restore the condition before being treated for the image formation.

Heretofore, a heat sensitive recording material described above is used as the surface stock in the labels used for the control of distribution of articles described above, and information such as the address, the name of the sender, the name of the article, the number and the weight of the article, the date of production, the best-before date, the specific identification number and the lot number or the bar code expressing the information is printed using a thermal printer of the contact type, and the obtained label is attached to the adherend. When the object assigned to the label is achieved, the label is manually removed so that the adherend such as a container and a card board box can be utilized again, and great amounts of time and labor are required for the removal. Another label is attached to the adherend from which the previous label has been removed, and the adherend is used again.

As described above, it is the actual situation at present that a label is removed and another label is attached every time the adherent is used repeatedly. Therefore, a rewritable thermal label which can be used repeatedly for recording and erasing information while the label is not removed from the adherend in each reuse of the adherend but remains attached to the adherend is attracting attention. For example, a reversible heat sensitive recording material of the non-contact type having a means for recording and erasing visible information which is obtained by forming a heat sensitive color developing layer containing a dye precursor and a reversible color developing agent on a support is developed (for example, refer to Patent References 1 to 3). A combination of a rewritable recording medium allowing rewriting visible information and an IC tag allowing rewriting invisible information is also disclosed (refer to Patent Reference 4).

When the recording of visible information is repeated a plurality of times by rewriting and/or erasing with laser light in the non-contact manner, a problem arises in that the surface of the recording medium is destroyed with heat due to the laser light applied repeatedly. Although the destruction can be suppressed by using a material for laser light absorption and heat conversion, the problem cannot be overcome completely. Other problems arise in that dirt is attached to the recording medium to cause trouble in printing and that other articles and containers hit the surface of the recording medium to deform or detach the recording medium and impair the function of the IC tag.

[Patent Reference 1] Japanese Patent Application Laid-Open No. 2003-118238

[Patent Reference 2] Japanese Patent Application Laid-Open No. 2006-231647

[Patent Reference 3] Japanese Patent No. 2741435

[Patent Reference 4] Japanese Patent Application Laid-Open No. 2004-265249

DISCLOSURE OF THE INVENTION

Under the above circumstances, the present invention has an object of providing a technology which can overcome the problems in rewriting visible information in the non-contact manner using laser light such as destruction of the surface of the recording medium by heat due to laser light, decrease in durability during cleaning to remove dirt (lifting and cleavage), deformation and detachment of recording media and damages on IC tags by impact during transportation and deterioration in the color developing property due to light such as sun light.

As the result of intensive studies by the present inventors to achieve the above object, it was found that the improvement in durability of the recording medium under repeated irradiation with laser light, the prevention of attachment of dirt to the surface of the recording medium and the protection from outside impact could be achieved with a structure formed of a resin material with a built-in recording medium which is held inside of the structure and comprises at least a means for rewriting visible information with a laser light in a non-contact manner or with a laminate using the structure.

It was also found that the recording could be conducted without decreasing the speed of recording or the density of recording and further, the breakage of the surface of the structure formed of a resin material could be reduced and the visible information could be recognized visually by adjusting the transmittance of a laser light in a used wavelength range and a transmittance of visible light through a portion of the structure formed of a resin material from a surface on which the laser light is irradiated to the recording medium to each 55% or greater, respectively.

It was also found that, when the recording medium at the inside of the structure formed of a resin material had a means for rewriting visible information in the non-contact manner and a means for recording and erasing invisible information as the function of an IC, recording and/or erasing invisible information in the IC chip in the non-contact manner by an reader/writer and recording and/or erasing visible information in the non-contact manner with laser light through the surface of the structure with a built-in recording medium could be easily conducted simultaneously while the structure formed of a resin material with a built-in recording medium was transported.

The present invention has been completed based on the knowledge.

The present invention provides:

[1] A structure with a built-in recording medium formed of a resin material, said recording medium being held inside of the structure and comprising at least a means for rewriting visible information with a laser light in a non-contact manner, wherein recording and erasing of information in the recording medium can be conducted by irradiation with a laser light from outside of the structure, and a transmittance of a laser light in a used wavelength range and a transmittance of visible light through a portion of the structure from a surface on which the laser light is irradiated to the recording medium are each 55% or greater, respectively;

[2] The structure with a built-in recording medium according described in [1], wherein the resin material forming the structure made is at least one resin material selected from the group consisting of a polystyrene resin, a low density polyethylene resin, a polycarbonate resin, a polypropylene resin, a polyethylene terephthalate resin, a polybutylene terephthalate resin and a polyamide resin;

[3] The structure with a built-in recording medium described in any one of [1] and [2], wherein the recording medium comprises a reversible heat sensitive color developing layer disposed on a support;

[4] The structure with a built-in recording medium described in [3], wherein the used wavelength range of the laser light is 700 to 1,500 nm and, in the recording medium, the reversible heat sensitive color developing layer comprises an agent for laser light absorption and heat conversion, or a laser light absorption and heat conversion layer is disposed on the reversible heat sensitive color developing layer;

[5] The structure with a built-in recording medium described in any one of [1] to [4], wherein the recording medium held at inside of the structure formed of a resin material is placed at a depth of 35 mm or smaller from a surface irradiated with laser light in the structure formed of a resin material;

[6] The structure with a built-in recording medium described in any one of [1] to [5], wherein the recording medium further comprises a means for recording and erasing invisible information with laser light in a non-contact manner;

[7] The structure with a built-in recording medium described in [6], wherein the means for recording and erasing invisible information comprises an IC chip and an antenna circuit connected to the IC chip;

[8] A laminate comprising a structure with a built-in recording medium which is formed by attaching the structure described in any one of [1] to [7] to a surface of an other structure;

[9] A method for recording in a non-contact manner which comprises rewriting visible information in the structure with a built-in recording medium described in any one of [1] to [5] with laser light applied through surface of the structure or in the laminate comprising a structure with a built-in recording medium described in [8] with laser light applied through surface of the structure; and

[10] A method for recording in a non-contact manner which comprises recording and/or erasing both invisible information in an IC chip using a reader/writer and visible information with laser light applied through surface simultaneously in a non-contact manner during transportation of the structure with a built-in recording medium described in any one of [6] and [7] or the laminate comprising a structure with a built-in recording medium described in [8].

THE EFFECT OF THE INVENTION

In accordance with the present invention, the structure formed of a resin material holding at the inside thereof a recording medium comprising at least a means for rewriting visible information with laser light in the non-contact manner and the laminate comprising the structure, which provide improvement in durability of the recording medium under repeated irradiation with laser light, prevention of attachment of dirt to the surface of the recording medium and protection from external impact, and the method for recording visible information or both of visible information and invisible information using the structure or the laminate comprising the structure in the non-contact manner can be provided.

Figure 1:
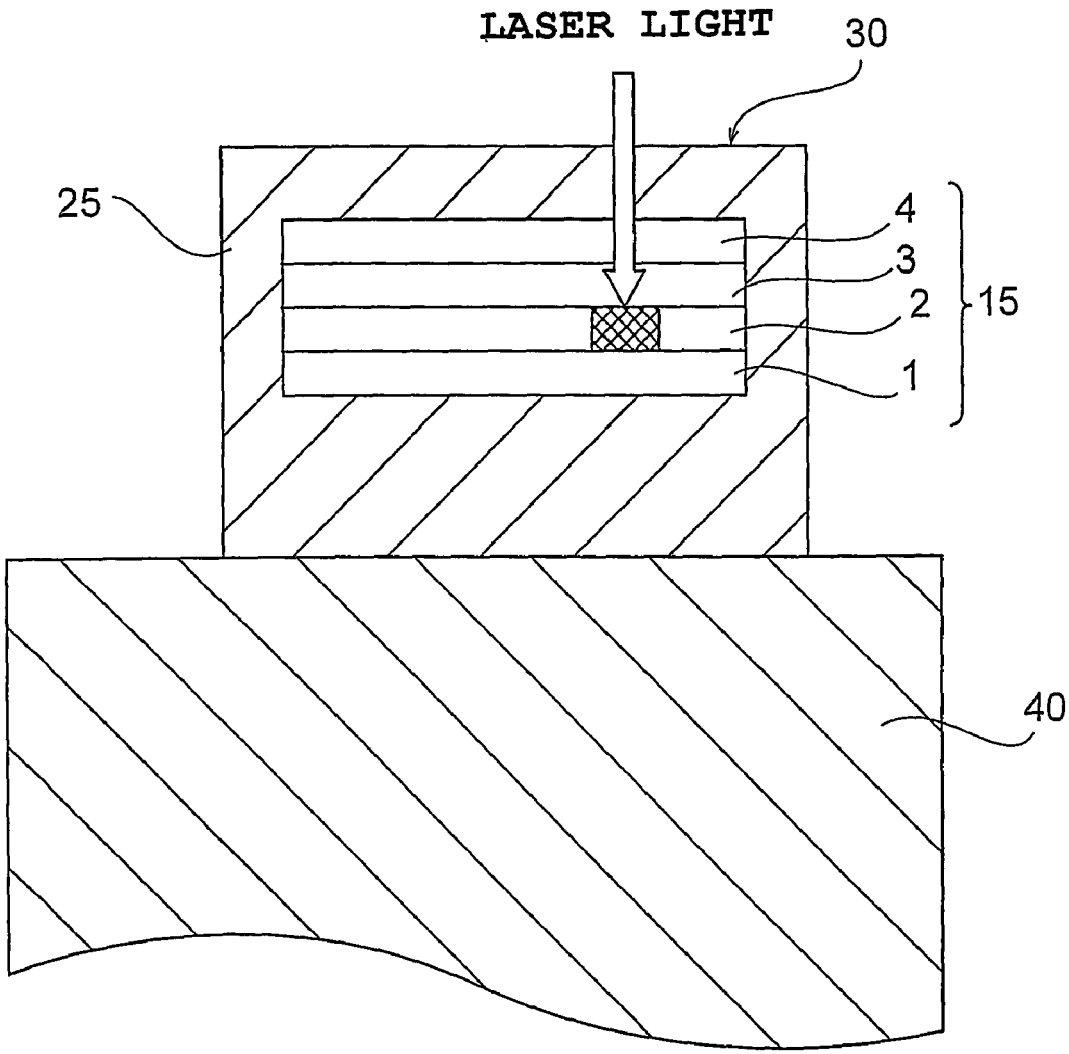
FIG. 1 shows a diagram exhibiting an image of an example of the construction of the laminate comprising the structure with a built-in recording medium of the present invention.

In the Figures, reference numerals mean as follows:

1: A support
2: A reversible heat sensitive color developing layer
3: A laser light absorption and heat conversion layer
4: A resin sheet layer
5: An anchor coat layer
6: A pressure sensitive adhesive layer
7: An adhesive layer
8: An antenna circuit
9: An IC chip
10: An insulating ink
11: An adhesive
12: A pressure sensitive adhesive layer
13: A release sheet
14: An electrically conductive paste
15: A recording medium
20*a*, 20*b*: RWT-IC tags
25: A structure formed of a resin material
30: A structure with a built-in recording medium
40: An other structure

THE MOST PREFERRED EMBODIMENT TO CARRY OUT THE INVENTION

The structure with a built-in recording medium of the present invention is a structure formed of a resin material holding at the inside thereof a recording medium comprising at least a means for rewriting visible information with laser light in a non-contact manner. The recording medium has a function such that an information in the recording medium can be recorded and erased by irradiation with laser light from the outside of the structure.

In the structure with a built-in recording medium of the present invention, the resin material for forming the structure is not particularly limited as long as a transmittance of a laser light in a used wavelength range and a transmittance of visible light through a portion of the structure from a surface on which the laser light is irradiated to the recording medium are each 55% or greater, respectively, and various amorphous resins and crystalline resins transmitting laser light can be used.

Preferable examples of the amorphous resin transmitting laser light include polystyrene, low density polyethylene and polycarbonate. Preferable examples of the crystalline resin transmitting laser light include polypropylene, polyethylene terephthalate, polybutylene terephthalate and polyamides. Resins obtained by modifying the above resins to provide rubber elasticity can also be used from the standpoint of the absorption of impact force. In the present invention, the resin transmitting laser light described above may be used singly or in combination of two or more. Resins which easily transmits laser light, have a high glass transition temperature Tg and exhibit heat resistance are preferable. The structure formed of a resin material may be colored as long as the above requirements for the transmittances are satisfied.

In the present invention, the means for holding the recording medium at the inside of the structure formed of a resin material is not particularly limited. For example, the recording medium may be adhered to a position at the inside of the structure formed of a resin material via a (pressure sensitive) adhesive [in the present invention, the terminology, "a (pressure sensitive) adhesive" means "a pressure sensitive adhesive" or "an adhesive"] disposed on the back face of the recording medium in the molding step, or the recording medium may be attached to a position at the inside of the structure formed of a resin material by the in-mold molding method in which the recording medium is inserted into a mold without using a (pressure sensitive) adhesive so that the recording medium is placed on the back face of the structure formed of a resin in the mold at the time of the injection molding. That "the recording medium is held at the inside of the structure" means that the recording medium is embedded at the inside of the resin material constituting the structure formed of a resin material.

The structure with a built-in recording medium can be prepared as follows: a protective layer formed of a resin material having a crosslinked structure is formed by forming a protective layer of a curable resin on the front face of the recording medium, followed by curing the formed layer, and the back face of the recording medium is integrally adhered with the structure formed of a resin, for example, via a (pressure sensitive) adhesive. In this case also, it is necessary that the protective layer satisfy the requirements for the transmittance of laser light and the transmittance of visible light described above. As the resin used for the protective layer, a resin which easily transmits laser light, has a high glass transition temperature Tg and exhibits heat resistance is preferable. Examples of the resin include the resins described as the examples of the resin material for the structure formed of a resin material.

In the present invention, the structure with a built-in recording medium obtained as described above can be bonded to the surface of other structure. In this case, the other structure may be formed of a resin material or formed of a material other than a resin material. When the other structure is formed of a resin material, the structure with a built-in recording medium may be bonded to the surface of the other structure by means of melt adhesion by heating or bonded via a (pressure sensitive) adhesive. The recording medium may be inserted between the other structure and the structure obtained from the resin transmitting laser light described above, and the two structures may be bonded together by means of melt adhesion by heating or via a (pressure sensitive) adhesive.

When the other structure is formed of a material other than a resin material, in general, the structure with a built-in recording medium is bonded to the surface of the other structure via a (pressure sensitive) adhesive.

The structure with a built-in recording medium may be a structure obtained by preparing a structure having a cavity into which the recording medium can be inserted by blow molding of the resin transmitting laser light, followed by inserting the recording medium into the formed cavity, or a structure obtained by preparing a structure having a pouched pocket, followed by inserting the recording medium into the pocket. In the present invention, the method for molding the structure which is formed of a resin material transmitting laser light described above and holds the recording medium at the inside thereof is not particularly limited. When the rate of cooling is increased during the molding, transparency of the structure formed of a resin material can be improved, and decreases in the transmittance of laser light and decreases in the transmittance of visible light can be suppressed.

In the structure with a built-in recording medium of the present invention, it is necessary that a transmittance of a laser light in a used wave length range and a transmittance of visible light through a portion of the structure from a surface on which the laser light is irradiated to the recording medium are each 55% or greater, preferably 60% or greater and most preferably 70% or greater, respectively. When the transmittance of laser light is 55% or greater, the recording can be achieved without decreases in the speed of recording and the density of recording. The destruction of the surface of the structure formed of a resin material with laser light can also be suppressed. When the transmittance of visible light is 55% or greater, visible information can be recognized by viewing. For reading a bar code, a transmittance more than above-mentioned value is necessary at the wavelength used by the bar code reader.

When the position of the recording medium held at the inside of the structure formed of a resin material (the depth from the surface irradiated with laser light) is excessively deep, the absorption of laser light with the resin constituting the structure increases, and problems such as poor color development and poor erasing due to insufficient energy and destruction of the surface of the structure formed of a resin material arise. Therefore, it is necessary that the recording medium be placed at a depth of 35 mm or smaller and preferably 30 mm or smaller from the surface irradiated with laser light.

To provide the amount of heat necessary for recording and erasing to rewrite visible information and for the color development and the erasing of the reversible heat sensitive recording layer of the recording medium which is placed at the inside of the structure formed of a resin material without destruction of the surface of the structure, a transmittance of laser light of 55% or greater is necessary so that the loss in the energy of laser light can be suppressed. With consideration on the visibility of the visible information recorded in the reversible heat sensitive color developing layer and the readability of bar codes, it is preferable that the structure is prepared in a manner such that a resin layer having a transmittance of light in the visible range of 55% or greater and a thickness in the range of 0.01 to 35 mm is disposed on the recording medium.

Holding the recording medium at the inside of the structure formed of a resin material contributes to the protection from outside factors which has heretofore been difficult to achieve, for example, to the solvent resistance and the light resistance.

Attachment of dirt due to the electrostatic action can be prevented by coating the surface of the structure with an antistatic agent or by adding an antistatic agent at the inside of the structure.

As for the wavelength of laser light used for recording and erasing, it is preferable that near infrared laser light of 700 to 1,500 nm is used at the minimum sufficient output so that the surface of the structure formed of a resin material is not destroyed.

When the wavelength is longer than the above range or when the transmittance of laser light of the structure formed of a resin material is small and laser light is absorbed, the surface of the structure tends to be destroyed by heat.

In the structure with a built-in recording medium of the present invention, where necessary, a material exhibiting the effect of absorbing ultraviolet light and visible light may be used for the resin placed at the inside at the side of the front face (the face irradiated with laser light) of the recording medium by adding into the resin or by coating the surface of the resin as long as the transmittance of laser light and the transmittance of visible light are both 55% or greater. It is also effective for absorption of visible light that coloring is conducted in a manner such that the transmittances are not adversely affected. Due to the above treatments, decomposition of a dye precursor in the reversible heat sensitive color developing layer in the recording medium can be suppressed. Therefore, the property for storage of recorded images can be improved, and the residual images after the erasing can be decreased.

In the structure with a built-in recording medium of the present invention, the recording medium at the inside comprises at least a means for rewriting visible information in the non-contact manner. A recording medium having a reversible heat sensitive color developing layer on a support can be used.

The support is not particularly limited. Examples of the support include plastic films such as films of polystyrene, acrylonitrile-butadiene-styrene resins, polycarbonates, polypropylene, polyethylene, polyethylene terephthalate and polyethylene naphthalate, synthetic paper, non-woven fabrics, paper and the like. The thickness of the support is not particularly limited. The thickness is, in general, in the range of 10 to 500 μm and preferably in the range of 20 to 200 μm. When the plastic film is used as the support, where desired, the support may be treated on one or both faces by a surface treatment such as the oxidation treatment or the roughening treatment to improve adhesion with an anchor coat layer and a (pressure sensitive) adhesive layer formed on the surface. Examples of the oxidation treatment include the treatment by corona discharge, the treatment with chromic acid (a wet method), the treatment with flame, the treatment with the heated air and the treatment with ozone under irradiation with ultraviolet light. Examples of the roughening treatment include the sand blasting and the treatment with a solvent. The surface treatment is suitably selected depending on the type of the support. In general, the treatment by corona discharge is preferable from the standpoint of the effect and the operability.

It is also effective that a foamed film exhibiting an excellent heat insulating effect is used as the support so that the heat during the recording of information with laser light is effectively utilized. Plastic films exhibiting the excellent property for repeated use are preferable as the support.

An anchor coat layer may be formed on one face of the support. The anchor coat layer is formed for improving adhesion between the reversible heat sensitive color developing layer and the support and for protecting the support from solvents in the coating fluid used for forming the reversible heat sensitive color developing layer in the next step. A support having poor solvent resistance can be used by forming the anchor coat layer.

The resin constituting the anchor coat layer is not particularly limited, and various resins can be used. Crosslinked resins exhibiting excellent solvent resistance are preferable. Examples of resins usable for forming crosslinked resins include acrylic resins, polyester-based resins, polyurethane-based resins and ethylene-vinyl acetate copolymers which can be crosslinked. When a material exhibiting poor solvent resistance is used as the support, it is preferable that a coating fluid which is not the organic solvent type such as coating fluids of the aqueous solution type and coating fluids of the water dispersion type is used for forming the anchor coat layer. The method for the crosslinking is not particularly limited, and a suitable method can be selected and used from various conventional methods depending on the type of the resin used.

It is also effective that a resin which can be crosslinked and cured with an ionizing radiation such as ultraviolet light and electron beams is used as the resin of the non-solvent type. When the resin which can be cured with the ionizing radiation is used, the crosslinking density can be easily adjusted by changing the amount of light used for the irradiation and, moreover, a crosslinked resin having a great crosslinking density can be formed.

The reversible heat sensitive color developing layer formed on the surface of the support is, in general, constituted with a colorless or slightly colored dye precursor, a reversible color developing agent and, where necessary, binders, accelerators for erasing of color, inorganic pigments and various other additives.

The dye precursor is not particularly limited, and a compound can be suitably selected as desired from compounds publicly known and conventionally used as the dye precursor in heat sensitive recording materials. For example, one compound or a combination of compounds selected from triarylmethane-based compounds such as 3,3-bis(4-dimethylaminophenyl)-6-dimethyl-aminophthalide, 3-(4-dimethylaminophenyl)-3-(1,2-dimethylindol-3-yl)-phthalide and 3-(4-diethylamino-2-ethoxyphenyl)-3-(1-ethyl-2-methyl-indol-3-yl)-4-azaphthalide, xanthene-based compounds such as rhodamine B anilino lactam and 3-(N-ethyl-N-tolyl)amino-6-methyl-7-anilinofluorane, diphenylmethane-based compounds such as 4,4'-bis(dimethylaminophenyl)benzhydryl benzyl ether and N-chlorophenylleucoauramine, spiro-based compounds such as 3-methylspirodinaphthopyran and 3-ethylspirodinaphthopyran and thiazine-based compounds such as benzoyl leucomethylene blue and p-nitrobenzoyl leucomethylene blue, can be used.

The reversible color developing agent is not particularly limited as long as the color developing agent reversibly changes the color tone of the dye precursor by the difference in the rate of cooling after heating. Electron accepting compounds comprising phenol derivatives having a long chain alkyl group are preferable from the standpoint of the density of the developed color, the property for erasing the color and the durability in repeated operations.

The phenol derivative may have atoms such as oxygen atom and sulfur atom and amide bond in the molecule. The length and the number of the alkyl group are selected with consideration on the balance between the property for erasing the color and the property for developing the color. It is preferable that the number of carbon atom in the alkyl group is 8 or greater and more preferably about 8 to 24. Hydrazine compounds, anilide compounds and urea compounds having a long chain alkyl group as the side chain can also be used.

Examples of the phenol derivative having a long chain alkyl group include 4-(N-methyl-N-octadecylsulfonylamino)phenol, N-(4-hydroxyphenyl)-N'-n-octadecylthiourea, N-(4-hydroxyphenyl)-N'-n-octadecylurea, N-(4-hydroxyphenyl)-N'-n-octadecylthioamide, N-[3-(4-hydroxyphenyl)-propiono]-N'-octadecanohydrazide and 4'-hydroxy-4-octadecylbenzanilide.

By utilizing the crystallizing property of the reversible color developing agent, when the information is recorded, the information can be recorded by a rapid cooling after heating for the recording of the information and when an information recorded is erased, the information can be erased by a slow cooling after heating for the erasing of the information and thus an information can be recorded and erased repeatedly.

When the recording medium is placed at the inside of the structure formed of a resin material, the cooling tends to be slow due to the heat insulation effect of the resin. Therefore, the structure formed of a resin material with a built-in recording medium may be cooled with air or cooled air to stabilize the condition of color development at the time of recording.

Examples of the binder used where necessary for holding components constituting the reversible heat sensitive color developing layer or maintaining uniformity of dispersion of the components include polymers such as polyacrylic acid, polyacrylic esters, polyacrylamide, polyvinyl acetate, polyurethane, polyesters, polyvinyl chloride, polyethylene, polyvinyl acetal and polyvinyl alcohol and copolymers of monomers constituting the polymers.

Examples of the accelerator for erasing of color which is used where desired include ammonium salts. Examples of the inorganic pigment which is used where desired include talc, kaolin, silica, titanium oxide, zinc oxide, magnesium carbonate and aluminum hydroxide. Examples of the other additive which is used where desired include conventional leveling agents and dispersants.

To form the reversible heat sensitive color developing layer, in the first step, a coating fluid is prepared by dissolving or dispersing the dye precursor described above, the reversible color developing agent described above and various components used where necessary into a suitable organic solvent. As the organic solvent, for example, an alcohol-based solvent, an ether-based solvent, an ester-based solvent, an aliphatic hydrocarbon-based solvent or an aromatic hydrocarbon-based solvent can be used. Tetrahydrofuran is preferable due to the excellent property for dispersion. The relative amounts of the dye precursor and the reversible color developing agent are not particularly limited. The reversible color developing agent is used, in general, in an amount in the range of 50 to 700 parts by mass and preferably in the range of 100 to 500 parts by mass per 100 parts by mass of the dye precursor.

The reversible heat sensitive color developing layer is formed on the support described above by coating the support with the coating fluid prepared as described above by a conventional method, followed by drying the formed coating layer. The temperature of the drying treatment is not particularly limited. It is preferable that the drying treatment is conducted at a low temperature so that color development of the dye precursor is prevented. The thickness of the reversible heat sensitive color developing layer formed as described above is, in general, in the range of 1 to 10 μm and preferably in the range of 2 to 7 μm.

In the rewritable recording medium of the present invention, a resin sheet layer and a protective layer may be formed on the reversible heat sensitive color developing layer formed as described above. The reversible heat sensitive color developing layer may further comprise an agent for laser light absorption and heat conversion and an ultraviolet light absorbent to maintain the density of the developed color. A layer comprising an agent for laser light absorption and heat conversion or a layer comprising an ultraviolet light absorbent may be disposed at the interface of the reversible heat sensitive color developing layer and the resin sheet or the protective layer.

The agent for laser light absorption and heat conversion exhibits the function of absorbing laser light supplied by the irradiation and converting the laser light into heat and can be suitably selected depending on the used laser light. As the laser light, it is preferable that laser light having a wavelength of oscillation in the range of 700 to 1,500 nm is selected from the standpoint of the transmission of laser light through the resin material for the structure formed of a resin material, the convenience of the apparatus and the property for scanning. For example, semiconductor laser light having a wavelength of 830 nm and laser light having a wavelength of 1,064 nm such as YAG laser light and FAYb laser light are preferable.

The agent for laser light absorption and heat conversion absorbs laser light in the near infrared range and generates heat, and it is preferable that the absorption of light in the visible range with the agent is small. When the agent for laser light absorption and heat conversion absorbs the light in the visible range, visibility and readability of bar codes by the rewritable recording medium of the present invention decrease. As the agent for laser light absorption and heat conversion satisfying the above requirement, organic dyes and/or organometal-based coloring agents are used. Specifically, for example, at least one agent selected from cyanine-based coloring agents, phthalocyanine-based coloring agents, anthraquinone-based coloring agents, azulene-based coloring agents, squalirium-based coloring agents, metal complex-based coloring agents, triphenylmethane-based coloring agents and indolenine-based coloring agents is used. Among these coloring agents, indolenine-based coloring agents are preferable due to the excellent property for converting light into heat.

The order of forming the layers in the recording medium is not particularly limited. For example, the anchor coat layer which is formed where necessary, the reversible heat sensitive color developing layer, the laser light absorption and heat conversion layer which is formed where necessary and the resin sheet layer or the protective layer are formed successively in this order on one face of the support.

When the reversible heat sensitive color developing layer comprises the agent for laser light absorption and heat conversion, the color development and the efficiency of erasing of color are further enhanced.

The anchor coat layer, the reversible heat sensitive color developing layer and the laser light absorption and heat conversion layer can be formed by applying the coating fluid for the respective layer using a coating method such as the direct gravure coating method, the gravure reverse coating method, the microgravure coating method, the coating method using a Mayer bar, an air knife, a blade, a die or a roll knife, the reverse coating method and the curtain coating method or a printing method such as the flexo printing method, the letter press printing method and the screen printing method, followed by drying the formed coating layer and heating the dried coating layer, where necessary. It is preferable that the reversible heat sensitive color developing layer is dried at a low temperature to prevent color development of the layer. When a resin of the ionizing radiation curing type is used, the resin is cured by irradiation with an ionizing radiation.

Then, the resin sheet layer or the protective layer is laminated on the reversible heat sensitive color developing layer comprising the agent for laser light absorption and heat conversion used where necessary or the laser light absorption and heat conversion layer formed where necessary. The resin sheet layer or the protective layer may be formed after prints are formed on the reversible heat sensitive color developing layer or the laser light absorption and heat conversion layer in advance. Alternatively, prints may be formed on the resin sheet layer or the protective layer after the resin sheet layer or the protective layer are formed. In this case, it is important that the prints are formed at a portion different from the portion for the rewritable printing with laser light.

For the resin sheet layer and the protective layer, a material which is not easily destroyed by heating due to the used laser light is used. Any desired resin material can be used when the requirements for the transmittance of the used laser light of 55% or greater and for the transmittance of visible light of 55% or greater are satisfied. It is preferable that the thickness of the resin sheet layer and the protective layer is 0.01 to 35 mm. When the thickness is smaller than 0.01 mm, there is the possibility that the function of protection against impact is insufficient. When the thickness exceeds 35 mm, visibility decreases due to the decrease in the transmittance of light. The efficiency in the recording and the erasing with laser light also decrease, and there is the possibility that the time required for rewriting increases. It is not preferable that the output of the laser is increased since destruction of the surface of the resin may take place.

When the resin sheet layer and the protective layer have the property of absorbing ultraviolet light, the decrease in the density of images and the decomposition of the coloring agent as the dye precursor and the agent for laser light absorption and heat conversion due to ultraviolet light such as the sunlight can be suppressed when the recording medium is left standing after the recording, and the light resistance of the recording medium is greatly enhanced.

The structure with a built-in recording medium of the present invention can be obtained by holding the recording medium comprising at least the means for rewriting visible information in the non-contact manner obtained as described above at the inside of the structure by the method described above. The structure with a built-in recording medium may be used for rewriting information in the non-contact manner by itself or in the condition attached to the surface of another structure, i.e., as a laminate comprising the structure with a built-in recording medium.

FIG. 1 shows a diagram exhibiting an image of an example of the construction of the laminate comprising the structure with a built-in recording medium of the present invention.

In the construction shown in FIG. 1, a structure with a built-in recording medium 30 comprises a recording medium 15 comprising a means for rewriting visible information in the non-contact manner at the inside of a structure formed of a resin material 25. The structure 30 is bonded to the surface of another structure 40. In the recording medium 15, a reversible heat sensitive color developing layer 2, a laser light absorption and heat conversion layer 3 and a resin sheet layer 4 are laminated in this order on one face of a support 1.

The structure with a built-in recording medium and the laminate comprising the structure with a built-in recording medium of the present invention having the above construction effectively exhibit the functions of increasing durability of the recording medium to laser light applied repeatedly, preventing attachment of dirt to the surface of the recording medium and protecting the recording medium from outside impact.

In FIG. 1, the recording medium 15 may have an IC tag on the face of the support 1 opposite to the face having the reversible heat sensitive color developing layer 2 via an adhesive layer as described below. When the recording medium 15 has an IC tag as described above, the recording and/or the erasing of invisible information in an IC chip using a reader/writer and the recording and/or the erasing of visible information with laser light can be conducted simultaneously during transportation in the non-contact manner.

In the structure with a built-in recording medium and the laminate comprising the structure with a built-in recording medium of the present invention, it is preferable that the distance between the recording medium and the source of laser light is 1 cm to 100 cm although the distance is different depending on the output power for the irradiation. It is preferable from the standpoint of image formation that the diameter of the beam of laser light is concentrated to about 1 to 300 μm at the surface of the recording medium. As for the scanning speed, a greater speed is more advantageous due to a smaller recording time. It is preferable that the scanning speed is 0.5 m/second or greater and more preferably 3 m/second or greater. As for the output power of the laser, 50 mW or greater is sufficient. It is practically preferable for increasing the printing speed that the output power is about 300 to 50,000 mW.

An image can be obtained by cooling, including cooling by leaving standing, after the irradiation with laser light is conducted as described above. When the rate of cooling is decreased due to heat accumulation or conditions of the environment, there is the possibility that the density of image is decreased or the color is lost. The cooling may be conducted alternatively or simultaneously with the scanning with laser light.

The structure with a built-in recording medium and the laminate comprising the structure with a built-in recording medium of the present invention are cleaned for the reuse after the object such as the transportation of an article has been achieved, where necessary. As the method for the cleaning, the method of removing foreign substances by blowing the air, the method of washing with water or the method of cleaning with warm alkaline water can be used.

For the reuse of the structure and the laminate comprising the structure after a use, it is necessary that the information in the recording medium at the inside be rewritten with a novel information. In this case, the recording medium at the inside of the structure is heated in the first step. For the heating, a temperature in the range of about 50 to 180° C. and preferably 70 to 150° C. is advantageous. The temperature may be varied depending on the type of the reversible color developing agent and the accelerator for erasing of color in the reversible heat sensitive color developing layer. As the method for the heating, the method of bringing into contact with a heated roll, the method of blowing the heated air and the method of slowly decreasing the elevated temperature of the recording medium by increasing the time or the output power of irradiation with laser light. After the heating, the recording medium is slowly cooled by leaving standing or by blowing the cold air so that the recorded information is erased. As for the environment for the slow cooling other than the cooling by leaving standing, the effect of the slow cooling can be exhibited by controlling the time of heating or the temperature of heating. In the present invention, heating with laser light is most suitable as the means for heating the recording medium through the structure for erasing as described below.

After the information is erased as described above, a novel information is recorded by the method of the non-contact type described above. The structure or the laminate comprising the structure can be used repeatedly by repeating the steps described above.

In the present invention, the recording and the erasing can be repeated 1,000 times or greater. When the structure and the laminate comprising the structure have been used the prescribed times, the structure and the laminate comprising the structure can be transferred to the step of recycling without separating into components, where necessary. In this case, it is preferable that the materials of the support or the resin sheet and the materials of the structure or the laminate comprising the structure are the same or compatible with each other. When the recording medium has an IC chip or a circuit as described below, it is preferable that the recording medium is removed before the recycling. In this case, it is preferable that the structure with a built-in recording medium of the present invention is used in the condition attached to the surface of an other structure, i.e., as the laminate comprising the structures with a built-in recording medium, so that the structure with a built-in recording medium can be separated from the other structure after the object has been achieved.

Heretofore, when an adherend is recycled, it is necessary that a recording medium be removed since the recording medium is a foreign substance, and the strength of the recycled product decreases. Since conventional heat sensitive color developing agents develop color by heating and cause contamination of the recycled products, recycling of a combination of a medium label and an adherend is considered to be impossible. In contrast, the reversible heat sensitive color developing agent used in the present invention loses the color by being cooled slowly and does not develop color in the recycling step unlike conventional heat sensitive color developing agents. Therefore, the recording medium can be recycled in combination with the structure when the same material is used as the material of the support of the recording medium and the material of the structure.

In the present invention, it is preferable that near infrared laser beam having a wavelength in the range of 700 to 1,500 nm is used as laser light (laser beam). A wavelength shorter than 700 nm is not preferable since visibility and readability of marks read by optical reflection decrease. When the wavelength is longer than 1,500 nm, the surface of the structure and the protective layer is gradually destroyed due to the great effect of heat, and durability in the repeated recording and erasing tends to decrease. In the present invention, the above problems can be overcome by the irradiation of the structure and the protective layer having the specific optical property with laser light having the specific wavelength.

As the mode of recording in the present invention, the recording mode in which a scanning mirror is continuously driven without activating the oscillation of laser light and images are drawn by scanning with laser light under activation of oscillation of laser light only when the locus of laser beam which would be formed when laser light would be activated by oscillation (the virtual laser beam) moves at a substantially constant speed, is preferable.

As the method for erasing of a recorded image in the present invention, the heating with laser light or the heating with the heated air can be used. The means for heating is not particularly limited. Irradiation with near infrared laser having a wavelength of 700 to 1,500 nm is preferable.

When damages on the structure by the heat is considered, it is preferable that the heat necessary for efficient erasing is provided by irradiation with laser light through the surface of the structure or the protective layer. When the width of scanning line is 1.4 mm (the distance of irradiation: 235 mm), the erasing can be conducted by irradiation with laser light at an output power of 1 to 30 W and preferably 8 to 15 W. The scanning speed is 50 to 5,000 mm/second and preferably 300 to 1,000 mm/second. However, the scanning speed is not limited to the value described above and may be varied depending on the output power.

When the recording of an image is conducted after the previous image has been erased in the method for rewriting in the present invention, the recording is conducted by the same method as that in the first recording. In this case, the rewriting can be achieved by irradiation with laser beam under the non-contact condition although the recording medium is placed at the inside of the structure.

An IC tag comprising the recording medium in which an IC tag (comprising an IC chip and an antenna circuit) is disposed on the face of the support opposite to the face having the reversible heat sensitive color developing layer in the recording medium used in the present invention will be described in the following.

Recording and erasing of visible information in the IC tag comprising a recording medium used in the present invention can be conducted with laser light. The distance from the laser head within which recording and erasing of visible information is possible in the recording and erasing of visible information may be set at a different value from the distance from a component for recording and erasing of invisible information within which recording and erasing of invisible information is possible in recording and erasing of invisible information. Therefore, an efficient reader/writer which can achieve erasing and recording of information in the above IC tag in the non-contact manner by a single apparatus can be obtained by mounting a laser head for recording and erasing of visible information and the component for recording and erasing of invisible information in a same apparatus at positions different from each other.

In accordance with the present invention, the structure comprising at the inside thereof the recording medium which comprises the means for recording and erasing invisible information in the non-contact manner and the means for recording and erasing visible information in the non-contact manner and enables to record visible information with laser light can be provided.

In the rewritable recording medium comprising the means for recording and erasing invisible information and the means for recording and erasing visible information described above, invisible information of about several thousand characters can be recorded in the IC tag while the amount of visible information which can be recorded is about several ten characters although the amount of visible information is different depending on the size of the tag. Therefore, in accordance with the present invention, the minimum amount of necessary information can be recorded as the visible information, and other detailed information can be recorded as the invisible information. Thus, the IC tag comprising the recording medium which can hold a great amount of information in a small size can be provided.

The IC tag comprising a recording medium exhibits excellent impact resistance and can be rewritten repeatedly without destruction of the IC chip or the antenna circuit or destruction of the surface with laser light.

A reader/writer for the IC tag comprising a recording medium in which information can be erased and written in the non-contact manner by a single apparatus using both of the means for recording and erasing invisible information and the means for recording and erasing visible information in the IC tag comprising a recording medium and a system using the IC tag comprising a recording medium described above which is applied to the control of distribution of articles, can be provided. Since recording and erasing of data in the non-contact manner using the means for recording and erasing invisible information and the means for recording and erasing visible information are possible, the system having automated steps of recording and erasing data can be provided.

The IC tag comprising a recording medium comprises the means for recording and erasing invisible information and the means for recording and erasing visible information in which information can be recorded and erased in the non-contact manner and are disposed on the surface of the support. The IC tag comprising a recording medium will be referred to as an RWT-IC tag, occasionally.

As the means for recording and erasing invisible information in the RWT-IC tag, a means constituted with an IC chip conventionally used for IC tags and an antenna circuit connected to the IC chip can be used.

Figure 2:
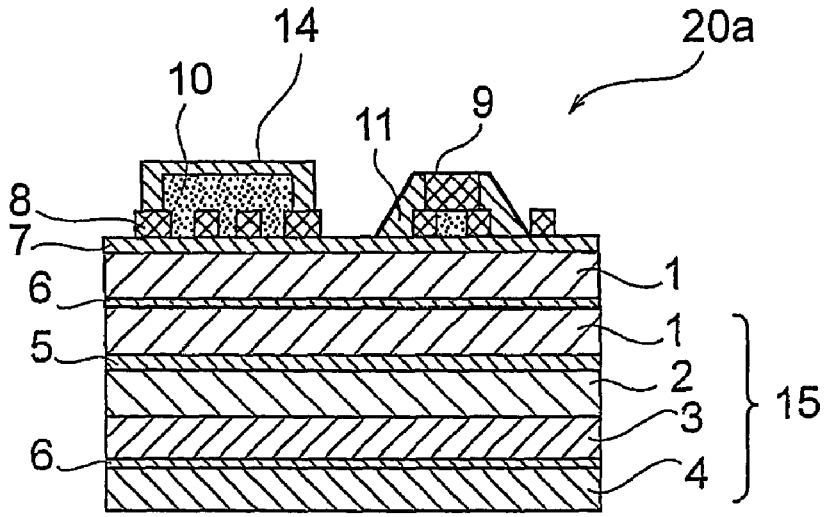
FIG. 2 shows a schematic sectional view of an example of the RWT-IC tag used in the present invention.
Figure 3:
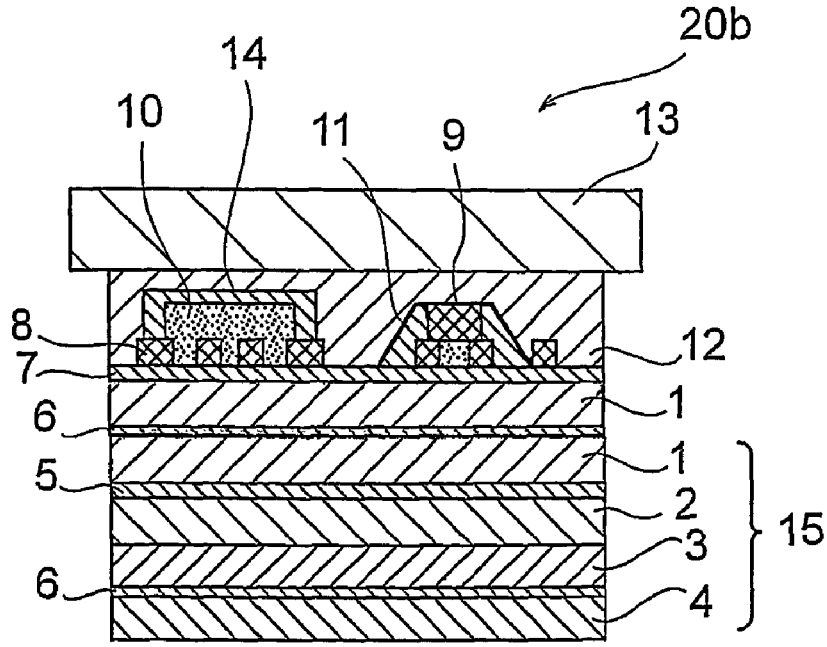
FIG. 3 shows a schematic sectional view of another example of the RWT-IC tag used in the present invention.

FIGS. 2 and 3 show schematic sectional views of examples of the RWT-IC tag used in the present invention.

In FIG. 2, in an RWT-IC tag 20*a*, a reversible heat sensitive color developing layer 2 is formed on one face of a support 1 via an anchor coat layer 5 which is formed where desired. A laser light absorption and heat conversion layer 3, a (pressure sensitive) adhesive layer 6 and a resin sheet layer 4 are formed on the reversible heat sensitive color developing layer 2 where desired, and a recording medium 15 having a means for rewriting visible information in the non-contact manner is formed. On the other face of the support 1, an antenna circuit 8 and an IC chip 9 connected to the antenna circuit 8 are disposed via an adhesive layer 7, and an IC tag which is the means for recording and erasing invisible information is formed. The numeral 10 means an insulating ink, the numeral 11 means an adhesive for mounting the IC chip 9, and the numeral 14 means an electrically conductive paste formed on the insulating ink.

In FIG. 3, an RWT-IC tag 20*b* has a structure such that the antenna circuit 8 and the IC Chip 9 connected to the antenna circuit 8 in FIG. 2 are covered with a pressure sensitive adhesive layer 12 having a release sheet 13.

The method for producing the RWT-IC tag used in the present invention will be described in the following.

In the first step, the antenna circuit 8 is formed on one face of the support 1 via the adhesive layer 7 and the IC chip 9 connected to the antenna circuit 8 is mounted to form the means for recording and erasing invisible information as described in the following.

A foil of an electrically conductive metal such as a copper foil or an aluminum foil is attached to one face of the support 1 via the adhesive layer 7. In this step, a thin film of an electrically conductive metal such as a thin film of copper and a thin film of aluminum may be formed directly without an adhesive layer on the support 1 by the vapor deposition or by the metal spraying although the adhesive layer 7 is formed in FIGS. 2 and 3. Then, an antenna pattern is formed by the etching method using the lithography. As another method, the antenna pattern may be formed by coating the support 1 with an electrically conductive paste by the silk screen printing method or the like. The electrically conductive paste contains metal particles such as silver powder, a resin for adhesion, a plasticizer and a solvent.

After the antenna pattern is formed as described above, the antenna circuit 8 is formed using an insulating ink 10 and an electrically conductive paste 14, and the IC chip 9 is mounted using an adhesive 11.

In the case of the example shown in FIG. 2, the antenna circuit obtained as described above is used. In the case of the example shown in FIG. 3, the antenna circuit 8 formed on one face of the support 1 via the adhesive layer 7 and the IC chip 9 connected to the antenna circuit 8 are covered with a pressure sensitive adhesive layer 12 having the release sheet 13. In FIG. 3, the pressure sensitive adhesive layer is a single layer. A double sided pressure sensitive adhesive tape having pressure sensitive adhesive layers on both sides of a core sheet such as a non-woven fabric and a plastic sheet may also used.

Then, the recording medium having the means for recording and erasing visible information described above are integrally bonded to the other face of the support 1 via a (pressure sensitive) adhesive layer (such as a double sided pressure sensitive adhesive tape), and the recording medium 15 having the means for recording and erasing visible information in the non-contact manner is formed.

In the final step, the obtained recording medium is cut into the prescribed shape, and the desired RWT-IC tag is obtained.

In the cutting, the release sheet 13 may have a size greater than the size of the RWT-IC tag as shown in FIG. 3 or the same size as the size of the RWT-IC tag.

The shape of the RWT-IC tag used in the present invention is not particularly limited. Examples of the shape include a label shape, a card shape, a coin shape and a stick shape. In general, the label shape (a rectangular shape) is used. In the case of the label shape, the size is, in general, about 5 to 100 mm×5 to 100 mm, and the thickness is about 100 to 1,000 μm (excluding the release sheet).

The RWT-IC tag shown in FIG. 2 and the RWT-IC tag shown in FIG. 3 which are prepared as described above can be used as the recording medium in the structure with a built-in recording medium of the present invention. When these RWT-IC tags are placed at the inside of the structure formed of a resin material as the recording medium comprising the means for recording and erasing invisible information in combination with the means for rewriting visible information in the non-contact manner, the recording medium is placed in a manner such that the reversible heat sensitive color developing layer of the recording medium faces the face of the structure irradiated with laser light.

In the case of the RWT-IC tag shown in FIG. 3, a pressure sensitive adhesive layer is formed on the face of the IC tag, and the position of the tag at the inside of the structure can be fixed easily by removing the release sheet.

The present invention also provides a method for recording in the non-contact manner which comprises rewriting visible information in the structure comprising the recording medium (the recording medium comprising a means for rewriting visible information in the non-contact manner) at the inside thereof of the present invention described above with laser light applied through the surface of the structure or in the structure having the recording medium at inside thereof in the laminate comprising the structure comprising a recording medium at inside thereof of the present invention described above with laser light applied through the surface of the structure; and a method for recording in the non-contact manner which comprises recording and/or erasing invisible information in an IC chip using a reader/writer and recording and/or erasing visible information with laser light applied through the surface simultaneously in the non-contact manner during transportation of the structure comprising the recording medium (the recording medium comprising a means for rewriting visible information in the non-contact manner and a means for recording and erasing invisible information) at inside thereof of the present invention described above or the laminate comprising the structure comprising a recording medium at inside thereof of the present invention described above.

By using the methods described above, the control system of distribution of articles in which erasing and recording are automatically conducted in the non-contact manner can be constructed. In particular, by using the structure comprising an RWT-IC tag at the inside thereof for control of distribution of articles, erasing or recording can be conducted in the non-contact manner using both of the means for recording and erasing invisible information in the RWT-IC tag and the means for recording and erasing visible information and, therefore, the structure comprising an RWT-IC tag at the inside thereof can be advantageously used for construction of the control system of distribution of articles.

The structure with a built-in recording medium and the laminate comprising the structure with a built-in recording medium of the present invention exhibit the following effects.

(1) Functions of increasing durability of the recording medium to laser light, preventing attachment of dirt to the surface of the recording medium and protecting the recording medium from outside impact can be effectively exhibited.

(2) The recording surface of the recording medium has no damages due to heat destruction even after repeated recording and erasing of visible information, and reuse of 1,000 times or greater is made possible. The increase in the number of reuse of the recording medium decreases the amount of disposed materials and the cost of use per the single use.

(3) Since a specific material is used as the material of the structure formed of a resin material and the recording medium is placed at the specific depth, ability of recording and erasing with laser light, visibility of visible information and readability of bar codes by a bar code reader are not decreased.

(4) When the structure and a laminate (such as a container) is delivered, the operation of delivery is remarkably facilitated since the operation of delivery can be performed with human visual confirmation due to the excellent visibility. Moreover, mistakes in the delivery and mistakes in human visual confirmation can be extremely decreased by the control system utilizing the structure with a built-in recording medium or the laminate comprising the structure with a built-in recording medium.

(5) Due to the use of the RWT-IC tag comprising the means for recording and erasing invisible information and the means for rewriting visible information in the non-contact manner in combination with the function described in (1), automation can be achieved in all of the production fields such as steps of FA, inventory control and delivery and the distribution fields after the delivery, and great industrial advantages can be achieved.

EXAMPLES

The present invention will be described more specifically with reference to examples in the following. However, the present invention is not limited to the examples.

The evaluations of the rewritable recording medium obtained in each of the Examples are made by the methods described in the following.

<Method of Recording (Printing)>

Using a FAYb laser (the wavelength: 1064 nm) [manufactured by SUNX Limited; the trade name: "LP-V10"] as the laser marker used for irradiation with laser, recording was conducted.

Ten characters in the alphabet, A to J, having a thickness of 0.3 mm and a size of a 1 cm square were recorded under the following conditions: the distance of irradiation: 180 mm; the output of the laser: 10 W; the duty: 100%; the scanning speed: 1,000 mm/second; switching between ON and OFF at the starting point and the end point of a character under the continuous oscillation; the width of a line: 0.1 mm; and the distance between lines in forming a solid line: 0.05 mm.

<Method of Erasing >

Using the same laser marker as that used for the recording, a previously recorded image was erased under the following conditions: the distance of irradiation to the medium: 230 mm; the output of the laser: 10 W; the duty: 100%; the scanning speed: 350 mm/second; switching the laser between ON and OFF at the starting point and the ending point of the erasing area; the width of scanning: 1.4 mm; and the distance in forming a solid line: 0.05 mm. An area greater than the area for the recording by 5 mm for both of the width and the length was set as the area for erasing by scanning with laser.

<Test of Rewriting>

Recording and erasing by the methods described above were repeated 0 times or 500 times, and the presence or the absence of destruction of the surface was examined and evaluated by visual observation.

<Method of Evaluation of a Recorded Image>

After the recording was repeated a prescribed number of times in Examples and Comparative Examples, the condition of destruction of the surface of a sample was examined by visual observation or by using an optical microscope. In particular, the portion of the apex in the recorded character of the alphabet A was examined. For the evaluation of visibility, the visibility of a recorded character was evaluated after the recording was repeated 10 times.

The criterion for the evaluation was as follows:

good: The character was clear and easily recognized and read.

fair: The character could be recognized and read.

poor: The character could not be read.

<Transmittance of Laser Light and Transmittance of Visible Light>

The transmittance of laser light having a wavelength of 1,064 nm and the transmittance of visible light having a wavelength of 550 nm through the portion between the face irradiated with laser light and a recording medium were measured using a spectrophotometer "UV-3100PC" manufactured by SHIMADZU CORPORATION.

<Test of Impact Resistance>

The impact test of the surface of a structure (the face of the recording medium) was conducted by the method of Japanese Industrial Standard K 5600-5-3 using a Du Pont impact tester under the following conditions: the load: 9.8 N; the height: 10 cm; the core of impact: 12.7 mm; the temperature: 23° C.; and the humidity: 50% RH. The change in the appearance and the ability of the RFID communication (reading) after the impact test were examined.

<Communication Test of IC Tag>

The ability of communication was examined at a distance of 10 cm from a recording medium using a wireless IC tag reader/writer "RCT-200-01" manufactured by Welcat Inc.

<Density of Recording>

The optical density of a portion of recording with color development was measured using a MACBETH optical densitometer "RD918".

<Test of Cleaning>

Using an automobile washer with a high temperature water using city water, water heated at 50° C. was injected to the surface of a structure with a built-in recording medium at an amount of injection of 800 liters/hour, a pressure of injection of 4,900 kPa, an angle of injection of 45° and a distance of injection of 1 m for 1 minute, and the change in the appearance was examined. In particular, lifting and cleavage at the end portions of the interface of structure A and structure B were examined.

No change: No lifting or peeling off in the recording medium was found.

Change: Lifting and peeling off in the recording medium were visually confirmed.

Preparation Example 1

Preparation of a Coating Fluid for Forming a Reversible Heat Sensitive Color Developing Layer (Fluid A)

One hundred parts by mass of 3-(4-diethylamino-2-ethoxyphenyl)-3-(1-ethyl-2-methylindol-3-yl)-4-azaphthalide, which was a triarylmethane-based compound, as the dye precursor, 30 parts by mass of 4-(N-methyl-N-octadecylsulfonylamino)phenol as the reversible color developing agent, 1.5 parts by mass of polyvinyl acetal as the dispersant and 2,500 parts by mass of tetrahydrofuran as the diluting solvent were pulverized and dispersed by a pulverizer and a disper, and a coating fluid for forming a reversible heat sensitive color developing layer (Fluid A) was prepared.

Preparation Example 2

Preparation of a Coating Fluid for Forming a Light Absorption and Heat Conversion Layer (Fluid B)

One part by mass of an agent for near infrared light absorption and heat conversion (a nickel complex-based coloring agent) [manufactured by TOSCO Co., Ltd.; the trade name: "SDA-5131"], 100 parts by mass of a binder of the ultraviolet light curing type (a urethane acrylate) [manufactured by DAINICHI SEIKA Color & Chemicals Mfg. Co., Ltd.; the trade name: "PU-5(NS)"] and 3 parts by mass of an inorganic pigment (silica) [manufactured by NIPPON AEROSIL Co., Ltd.; the trade name: "AEROSIL R-972"] were dispersed by a disper, and a coating fluid for forming a light absorption and heat conversion layer (Fluid B) was prepared.

Example 1

(1) Preparation of a Recording Medium

A biaxially stretched film of polypropylene having a thickness of 40 μm [manufactured by Futamura Chemical Co., Ltd.; the trade name: "FOA 40"] used as the support of a recording medium was coated with Fluid A prepared in Preparation Example 1 in by the gravure printing method in an amount such that the thickness was 4 μm after being dried. The formed coating layer was dried in an oven at 60° C. for 5 minutes, and a reversible heat sensitive color developing layer was formed. The formed reversible heat sensitive color developing layer was then coated with Fluid B prepared in Preparation Example 2 by the flexo printing method in an amount such that the thickness was 1.2 μm after being dried. The formed coating layer was dried in an oven at 60° C. for 1 minute and then irradiated with ultraviolet light in an amount of 220 mJ/cm$^2$, and a laser light absorption and heat conversion layer was formed.

(2) Preparation of an IC Tag (Refer to FIG. 2)

An IC tag of the non-contact type constituted with an IC chip as the means for recording and erasing invisible information and an antenna circuit was prepared by the following method.

An antenna pattern was formed on a laminate obtained by laminating a copper foil to a film of polyethylene terephthalate having a thickness of 50 μm (a support 1) [manufactured by NIKKAN INDUSTRIES Co., Ltd.; the trade name: "NIKAFLEX"] by the etching method. After an insulating ink 10 [manufactured by Acheson Japan Limited; the trade name: "ML 25089"] was placed on the formed antenna pattern by printing, an antenna circuit 8 was formed by the screen printing method using an electrically conductive paste 14 [manufactured by TOYOBO Co., Ltd.; the trade name: "DW250L-1"]. An IC chip 9 [manufactured by Philips Semiconductors; "ICODE"] was mounted via an adhesive 11 [manufactured by KYOCERA CHEMICAL Corporation; the trade name: "TAP0402E"], and an IC tag was prepared.

(3) Bonding of the Recording Medium

The recording medium for visible information prepared in (1) and the IC tag prepared in (2) were adhered together using a double sided adhesive tape [manufactured by LINTEC Corporation; "TL-85S-50"], and the two recording media were bonded to each other.

(4) Preparation of a Structure with a Built-In Recording Medium

The recording media prepared in (3) were placed at the inside of a structure by the following procedures.

As Structure A, a structure having a size of 100 mm×100 mm and a thickness of 1 mm was molded with a polypropylene resin [manufactured by Japan Polypropylene Corporation; "NOVATEC PP"] using an injection molding machine [manufactured by Sumitomo Heavy Industries, Ltd.; the trade name: "NESTAL NEOMAT"]. In the molding, the cylinder temperature was 220° C., the mold temperature was 30° C., the rate of injection was 17 cm$^3$/second, and the cooling time was 60 seconds. Then, the face for recording of a sample having a size of 70 mm×70 mm of the recording medium prepared in (3) was bonded to the back face of the structure. The product was kept under heating to allow the adhesion to proceed, and a sample was prepared. The distance from the surface of Structure A to the face of the recording medium (the thickness of the molded resin) was 1 mm.

The obtained sample was brought into contact with the face of Structure B having a size of 150 mm×150 mm and a thickness of 50 mm and formed of the same polypropylene resin as that used for Structure A in a manner such that the recording medium faced the front face of Structure B, and the bonding was conducted by melt adhesion. In this manner, a structure with a built-in recording medium was prepared, and the properties of the prepared structure were evaluated. The results are shown in Table 1.

Example 2

A structure with a built-in recording medium was prepared by the same procedures as those conducted in Example 1 except that, in (4) of Example 1, the thickness of Structure A (the distance from the surface of Structure A to the surface of the recording medium) was changed to 10 mm, and the properties of the prepared structure were evaluated. The results are shown in Table 1.

Example 3

A structure with a built-in recording medium was prepared by the same procedures as those conducted in Example 1 except that, in (4) of Example 1, the thickness of Structure A (the distance from the surface of Structure A to the surface of the recording medium) was changed to 30 mm, and the properties of the prepared structure were evaluated. The results are shown in Table 1.

Example 4

A structure with a built-in recording medium was prepared by the same procedures as those conducted in Example 1 except that, in (4) of Example 1, the materials for Structure A and Structure B were both changed to polystyrene [manufactured by ASAHI KASEI Corporation; the trade name: "STYRON"], and the properties of the prepared structure were evaluated. The results are shown in Table 1.

Example 5

A structure with a built-in recording medium was prepared by the same procedures as those conducted in Example 1 except that, in (4) of Example 1, after Structure B was molded, a component formed of polypropylene and molded in advance into a bag shape having a size of 80 mm×80 mm and a thickness of 0.5 mm was pressed to the front face of Structure B under heating to form a molded portion having a pocket shape, and the recording medium was inserted into the inside of the pocket shape to prepare the structure with a built-in recording medium. The properties of the prepared structure were evaluated. The results are shown in Table 1.

Comparative Example 1

A label coated with a pressure sensitive adhesive [manufactured by TOYO INK MFG Co., Ltd.; the trade name: "ORIBAIN BPS-5127"] in an amount of 25 g/m$^2$ was attached to the back face of the recording medium obtained in (3) of Example 1. The obtained laminate was attached without further treatments to the front face of Structure B obtained in (4) of Example 1 to obtain a sample (no recording media at the inside). The properties of the prepared structure were evaluated. The results are shown in Table 1.

Comparative Example 2

A structure with a built-in recording medium was prepared by the same procedures as those conducted in Example 1 except that, in (4) of Example 1, the thickness of Structure A (the distance from the surface of Structure A to the surface of the recording medium) was changed to 40 mm, and the properties of the prepared structure were evaluated. The results are shown in Table 1.

Comparative Example 3

A recording medium having a polypropylene pressure sensitive adhesive laminate material [manufactured by LINTEC Corporation; the trade name: "PP20 PLN 7LK"] having a thickness of 20 μm was attached to the laser light absorption and heat conversion layer of the recording medium obtained in (3) of Example 1. The obtained laminate was attached without further treatments to the front face of Structure A obtained in (4) of Example 1 to obtain a sample (no recording media at the inside). The properties of the prepared structure were evaluated. The results are shown in Table 1.

TABLE 1

| | Example | | | | | Comparative Example | | |
|---|---|---|---|---|---|---|---|---|
| | 1 | 2 | 3 | 4 | 5 | 1 | 2 | 3 |
| Resin composition of structure | PP | PP | PP | PS | PP | — | PP | PP |
| Thickness of resin layer at front side of recording medium (mm) | 1 | 10 | 30 | 1 | 0.5 | — | 40 | 0.02 |
| Transmittance of laser light (%) | 90.5 | 86.1 | 78.2 | 83.6 | 91.5 | — | 61.8 | 92.2 |
| Transmittance of visible light (%) | 91.1 | 87.0 | 79.0 | 83.6 | 92.0 | — | 49.2 | 91.9 |
| Density of recording | 1.20 | 0.84 | 0.65 | 0.88 | 1.31 | 1.35 | 0.32 | 1.28 |
| Visibility of recorded image | good | fair | fair | fair | good | good | poor | good |
| Condition of destruction of surface, 0 times rewriting | none | none | none | none | none | none | none | none |
| Condition of destruction of surface, 500 times rewriting | none | none | none | none | none | found | none | none |
| Communication of IC tag after impact test | possible | possible | possible | possible | possible | not possible | possible | not possible |
| Appearance after cleaning test | no change | no change | no change | no change | no change | change | no change | change |

(PP: polypropylene; PS: polystyrene)

INDUSTRIAL APPLICABILITY

The structure with a built-in recording medium and the laminate comprising the structure with a built-in recording medium of the present invention are a structure formed of a resin material which comprises a recording medium comprising at least a means for rewriting visible information with laser light at the inside of the structure and a laminate comprising the structure, respectively. The structure and the laminate comprising the structure can effectively exhibit the functions of increasing durability of the recording medium to laser light applied repeatedly, preventing attachment of dirt to the surface of the recording medium and protecting the recording medium from outside impact, and the recording and the erasing can be repeated a great number of times.

In particular, when an RWT-IC tag is used as the recording medium, the erasing and the recording of information can be conducted using both of the means for recording and erasing invisible information and the means for recording and erasing visible information, and the structure can be advantageously used for construction of a system for the control of distribution of articles.

What is claimed is:

1. A structure with a built-in recording medium formed of a resin material, said recording medium being held inside of the structure and comprising at least a means for rewriting visible information with a laser light in a non-contact manner, wherein recording and erasing of information in the recording medium can be conducted by irradiation with a laser light from outside of the structure, and a transmittance of a laser light in a used wavelength range and a transmittance of visible light through a portion of the structure from a surface on which the laser light is irradiated to the recording medium are each 55% or greater, respectively.

2. The structure with a built-in recording medium according to claim 1, wherein the resin material forming the structure made is at least one resin material selected from the group consisting of a polystyrene resin, a low density polyethylene resin, a polycarbonate resin, a polypropylene resin, a polyethylene terephthalate resin, a polybutylene terephthalate resin and a polyamide resin.

3. The structure with a built-in recording medium according to claim 1, wherein the recording medium comprises a reversible heat sensitive color developing layer disposed on a support.

4. The structure with a built-in recording medium according to claim 3, wherein the used wavelength range of the laser light is 700 to 1,500 nm and, in the recording medium, the reversible heat sensitive color developing layer comprises an agent for laser light absorption and heat conversion, or a laser light absorption and heat conversion layer is disposed on the reversible heat sensitive color developing layer.

5. The structure with a built-in recording medium according to claim 1, wherein the recording medium is placed at a depth of 35 mm or smaller from a surface of the structure on which laser light is irradiated.

6. The structure with a built-in recording medium according to claim 1, wherein the recording medium further comprises a means for recording and erasing invisible information with laser light in a non-contact manner.

7. The structure with a built-in recording medium according to claim 6, wherein the means for recording and erasing invisible information comprises an IC chip and an antenna circuit connected to the IC chip.

8. A method for recording in a non-contact manner which comprises recording and/or erasing both invisible information in an IC chip using a reader/writer and visible information with laser light applied through surface simultaneously in a non-contact manner during transportation of the structure with a built-in recording medium described in claim 6.

9. A laminate comprising a structure with a built-in recording medium which is formed by attaching the structure described in claim 1 to a surface of an other structure.

10. A method for recording in a non-contact manner which comprises rewriting visible information in the laminate comprising a structure with a built-in recording medium described in claim 9 with laser light applied through surface of the structure.

11. A method for recording in a non-contact manner which comprises recording and/or erasing both invisible information in an IC chip using a reader/writer and visible information with laser light applied through surface simultaneously in a non-contact manner during transportation of the laminate comprising a structure with a built-in recording medium described in claim 9.

12. A method for recording in a non-contact manner which comprises rewriting visible information in the structure with a built-in recording medium described in claim 1 with laser light applied through surface of the structure.

* * * * *